US005284301A

United States Patent [19]

Kieffer

[11] Patent Number: 5,284,301

[45] Date of Patent: Feb. 8, 1994

[54] DOUBLE-PIVOT TRIGGER

[75] Inventor: Joseph W. Kieffer, Maple Grove, Minn.

[73] Assignee: Wagner Spray Tech Corporation, Minneapolis, Minn.

[21] Appl. No.: 991,489

[22] Filed: Dec. 15, 1992

[51] Int. Cl.[5] ..... B05B 7/24

[52] U.S. Cl. ..... 239/528

[58] Field of Search ..... 239/525, 526, 527, 318, 239/528

[56] References Cited

U.S. PATENT DOCUMENTS

| | | | |
|---|---|---|---|
| 1,524,283 | 1/1925 | Beach | 239/527 X |
| 2,149,932 | 3/1939 | Zippel | 239/527 X |
| 2,362,946 | 11/1944 | Stockdale | 239/526 X |
| 5,118,080 | 6/1992 | Hartmann | 239/526 X |

FOREIGN PATENT DOCUMENTS

| | | | |
|---|---|---|---|
| 2267154 | 4/1974 | France | 239/527 |
| 391937 | 5/1933 | United Kingdom | 239/526 |

*Primary Examiner*—Andres Kashnikow
*Assistant Examiner*—Kevin P. Weldon
*Attorney, Agent, or Firm*—Faegre & Benson

[57] ABSTRACT

A trigger for opening a valve against fluid pressure has two alternate pivot points. The first pivot point has a relatively higher mechanical advantage to make it easier to push the valve against the fluid pressure. The second pivot point has a relatively lower mechanical advantage to increase the distance travelled by the valve in response to further movement of the trigger to make it easier to control the flow of fluid pass the valve. The trigger thereby reduces the force required to open the valve without decreasing the range of motion of the valve.

18 Claims, 4 Drawing Sheets

DOUBLE-PIVOT TRIGGER

BACKGROUND OF THE INVENTION

The current invention relates to a trigger in a paint spray gun which opens a valve by pushing the valve against the pressure of a fluid, the fluid being either a liquid or a gas.

Paint can be applied evenly over a surface by being atomized by a paint spray gun. In the prior art, as shown in FIG. 1, a paint spray gun 10 atomizes paint found in container 12 by pulling the paint into a stream of air. Pressurized air enters the gun 10 through coupling 14 and passes through a hollow handle 16 into a preliminary air chamber 18. When trigger 20 is pulled, the trigger 20 pivots about pivot point 22, urging an actuator 24 rearward. The actuator 24 may be attached to trigger 20, or may merely abut trigger 20 without being physically attached. When the trigger 20 is released, a spring 25 urges the actuator 24 forward and the trigger 20 returns to the rest position shown in FIG. 1. The actuator 24 is effectively a stiff rod attached to an air valve 26 which serves to regulate the passage of air from preliminary air chamber 18 through the remainder of the gun 10. As actuator 24 moves rearward, the air valve 26 is also moved rearward away from valve seat 28. This movement pushes the valve 26 against the pressure of the pressurized air in preliminary air chamber 18. As a result of this pressure, a significant amount of force is required on the trigger 20 to move the valve 26 away from seat 28. However, once the actuator 24 has opened the valve 26, the pressurized air passes into air passageway 30, thereby substantially equalling the pressure on both sides of valve 26 and making the movement of the valve 26 easier. After the pressurized air enters passageway 30, it moves through air passageways 32, 34 and 36. Passageway 36 is in communication with a recess 38 in an air cap 40, thereby allowing the pressurized air to pass through recess 38 and exit gun 10 through an opening 42 in air cap 40. The volume of air exiting the gun 10 through opening 42 affects the characteristics of the atomized paint stream created by the gun 10. This volume is controlled by an air control mechanism 60.

When the trigger 20 moves the actuator 24 rearward, a needle end 50 of actuator 24 also moves rearward, thereby opening needle or paint valve 52. This allows paint in container 12 to pass through paint passageways 54 and 56 and to exit the gun 10 through paint valve 52. The passage of air through opening 42 acts to suction the paint out through paint valve 52 when paint valve 52 is open. When the paint exiting valve 52 enters the stream of pressurized air, the paint is atomized, thereby allowing the paint to be applied to a surface.

As the trigger 20 pushes the actuator 24 rearward, the actuator 24 first opens air valve 26 and then, after further rearward movement, opens paint valve 52. In order to open paint valve 52 fully, the actuator 24 must move rearward a significant distance relative to the distance required to open air valve 26. Thus, the trigger 20 must not only move the actuator 24 against the pressurized air to open air valve 26, but then must move the actuator 24 a sufficient distance so as to allow the operator to control the amount of paint exiting paint valve 52.

Unfortunately, this places two conflicting requirements on the design of trigger 20 and the placement of pivot point 22. Since a significant amount of force is required to unseat valve 26 from seat 28, it is useful to place the pivot point 22 relatively close to actuator 24. This would create a significant mechanical advantage in the trigger 20, making it easier for an operator to start air flowing through gun 10. On the other hand, since it is important to allow an operator to control the volume of paint passing through paint valve 52 during usage of the gun 10, it is helpful to have the pivot point 22 relatively far from the actuator 24, thereby allowing greater control over the amount of paint being sprayed.

A similar conflicting need is found in airless spray guns, where pressurized paint is atomized by forcing the paint through a paint nozzle at a high pressure. In these guns, the trigger must force a paint valve against the pressure of the pressurized paint. After opening the valve, the trigger must move the valve a significant distance from the seat in order to minimize paint flow resistance.

The present invention meets these dual needs by providing a trigger with two pivot points. The first pivot point is close to the actuator and is used while the trigger moves through a first range of motion. The location of this first pivot point increases the mechanical advantage of the trigger, thereby making it easier to open the valve against the fluid pressure. The second pivot point is further from the actuator and is used while the trigger moves through a second range of motion. The location of the second pivot point provides operation of the trigger at a decreased mechanical advantage thus increasing the distance travelled by the gun's actuator and valves in the second range of motion.

DETAILED DESCRIPTION OF THE INVENTION

Figure 2:
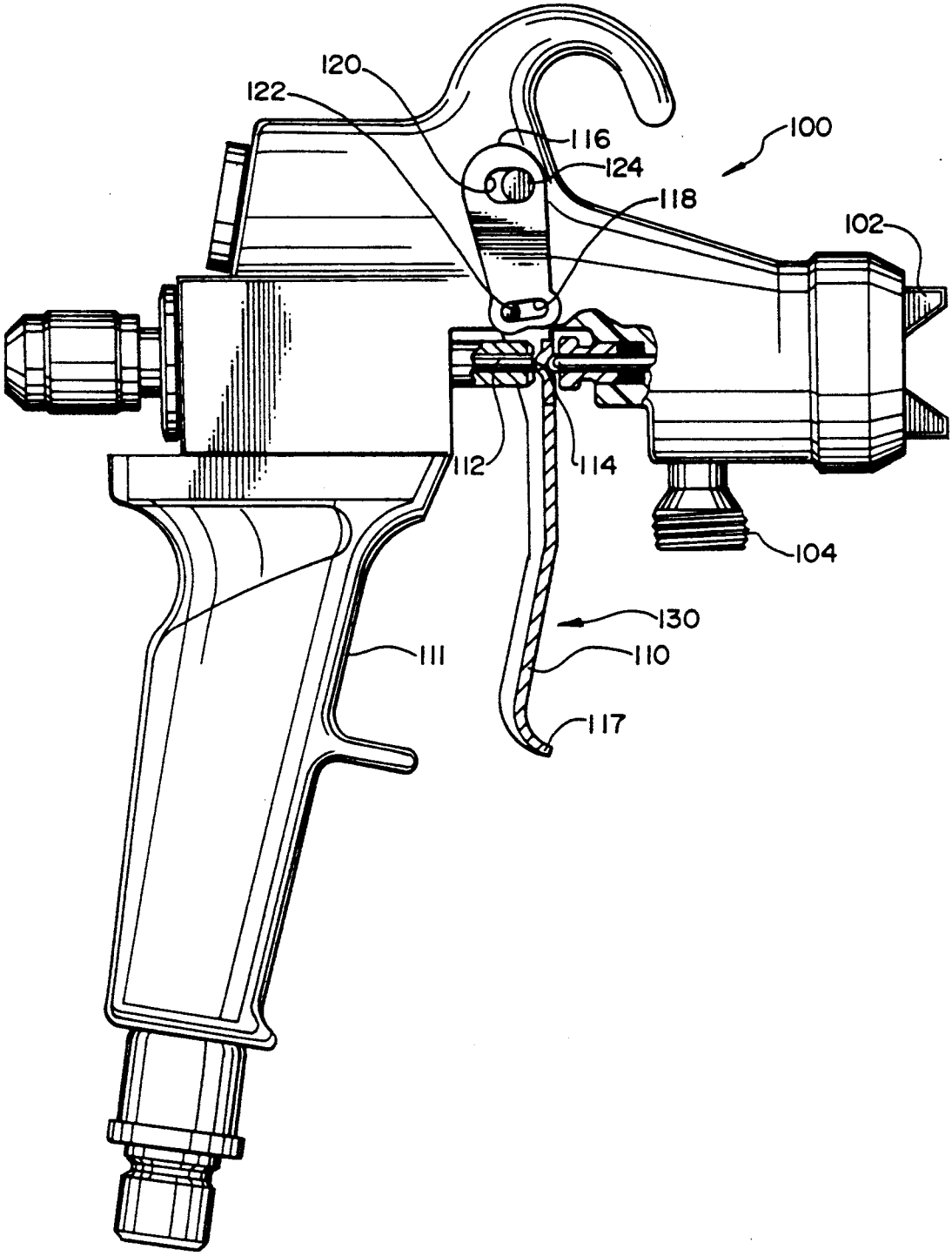
FIG. 2 is a right side elevation view of the present invention with parts cut away and with the trigger in a first or rest position.
Figure 3:
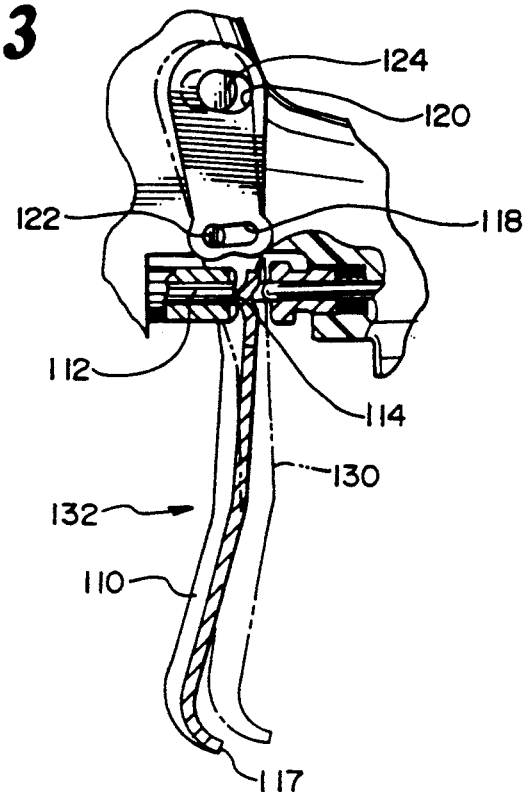
FIG. 3 is a right side fragmentary view of the invention of FIG. 2 with the trigger in a second or intermediate position and a phantom view of the trigger in the rest position.
Figure 4:
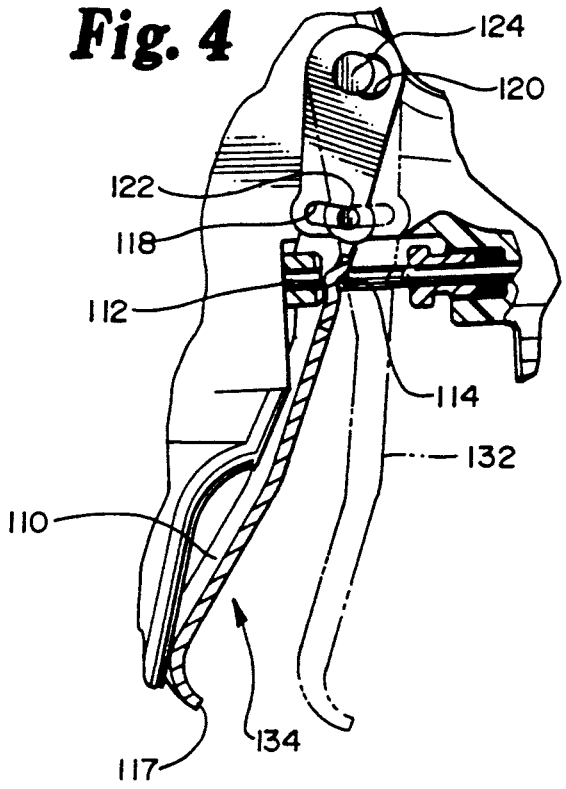
FIG. 4 is a right side fragmentary view of the invention of FIG. 2 with the trigger in a third or fully actuated position and a phantom view of the trigger in the second position.

Referring now to FIGS. 2–4, it is seen that the figures show the right side of a gun 100 and a partial cross section of trigger 110. It is to be understood that it is preferable, although not necessary, that the left and right sides of both gun 100 and trigger 110 are identical in both configuration and function. Thus, while the following discussion refers only to pivot points on the right side of the gun 100, such discussion may be equally applicable to pivot points on the left side of gun 100.

Referring now specifically to FIG. 2, paint gun 100 having trigger 110 of the present invention may be seen. The internal parts of gun 100 and the air flow through gun 100 is identical to the air flow through the prior art gun 10 of FIG. 1. Trigger 110 abuts an actuator 112 at actuator interface location 114. When trigger 110 is pulled, trigger 110 pushes actuator 112 rearward, which in turns opens an air valve (not shown) to allow pressurized air to pass through the gun 100. When the valve is opened, the pressurized air is allowed to flow through the gun 100, exiting through air cap 102. When the needle or paint valve is open, the exiting air will pull paint from a container connected to gun 100 through paint container coupling 104. The paint is then atomized, as is described above.

Trigger 110 has a first end 116, a second end 117, a first aperture or slot 118 and a second aperture or slot 120. Second slot 120 is located near the first end 116 of the trigger 110 and surrounds a second pivot peg 124, which is fixedly attached to gun 100. First slot 118 is located between second slot 120 and actuator interface location 114 and surrounds a first pivot peg 122, also fixedly attached to gun 100. The slots 118, 120 are designed so that the trigger 110 may move with respect to gun 100 with the slots 118, 120 sliding transversely past the pivot pegs 122, 124.

In the first or rest position 130 of trigger 110, as shown in FIG. 2, actuator 112 is urged by an internal spring against trigger 110, as was described above in connection with prior art gun 10 in FIG. 1. As a result, the trigger 110 is positioned so that the first pivot peg 122 is at the rear edge of first slot 118 while the second pivot peg 124 is at the front edge of second slot 120.

When the trigger 110 is grasped by an operator near the second end 117 and pulled toward a gun handle 111, the trigger 110 moves through a first range of motion. In this first range of motion, the trigger 110 pivots about first pivot peg 122 while the portion of the trigger 110 forming second slot 120 moves forward relative to second pivot peg 124. When the trigger 110 has been pulled sufficiently so that second pivot peg 124 is at the rear edge of the second slot 120, the trigger 110 is in the position shown in FIG. 3. FIG. 3 also shows in phantom the rest position 130 of the trigger 110 as shown in FIG. 2.

After the trigger 110 reaches the second or intermediate position 132 shown in FIG. 3, further pulling of the trigger 110 causes trigger 110 to move through a second range of motion. In this second range of motion, the trigger 110 pivots about the second pivot peg 124 while the portion of the trigger 110 forming the first slot 118 moves rearward relative to the first pivot peg 122. When the trigger 110 has been pulled sufficiently so that the first pivot peg 122 is located at the front edge of the first slot 118, the trigger 110 is in the third or fully actuated position 134 shown in FIG. 4. FIG. 4 shows in phantom the location of the intermediate position 132 of the trigger 110.

Figure 1:
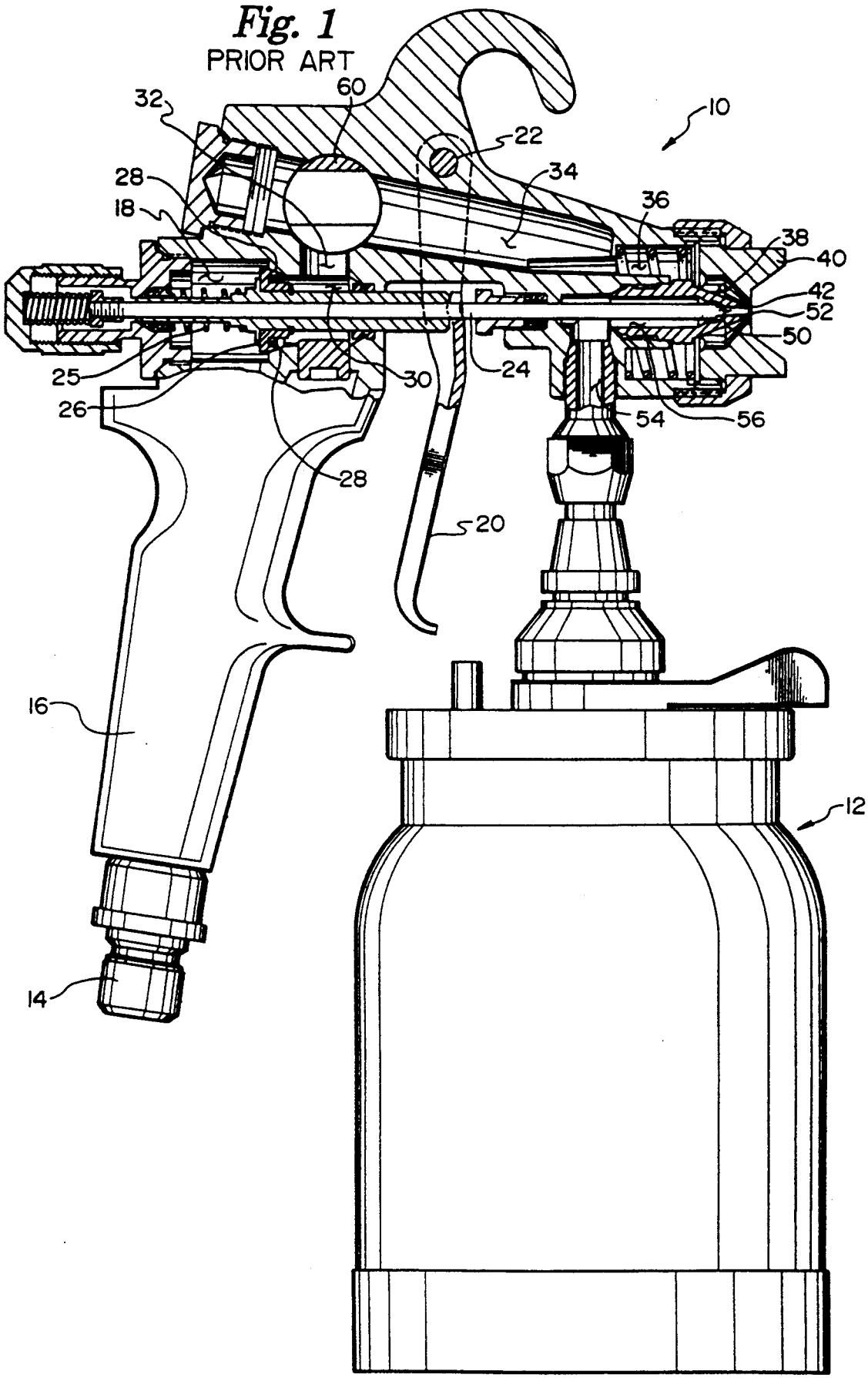
Fig. 1 PRIOR ART
FIG. 1 is a right side elevation view of a prior art spray gun and trigger with parts cut away.

When the trigger 110 is pivoting about first pivot peg 122 in the first range of motion, the trigger 110 operates to give the operator applying force near second end 117 a significant mechanical advantage while opening the valve (not shown in FIGS. 2–4 but connected to actuator 112 similarly or identically to the air valve 26 of FIG. 1). This mechanical advantage is shown more clearly in FIGS. 5–10. FIGS. 5–10 show trigger 110 and slots 118, 120 in dotted outline. Arrow 150 represents the force the actuator 112 applies to trigger 110 at the actuator interface location 114. Arrow 160 represents an equivalent or resultant force applied by an operator when pulling the trigger 110. The lines 170 represent an equivalent or resultant lever arm formed by trigger 110.

Figure 5:
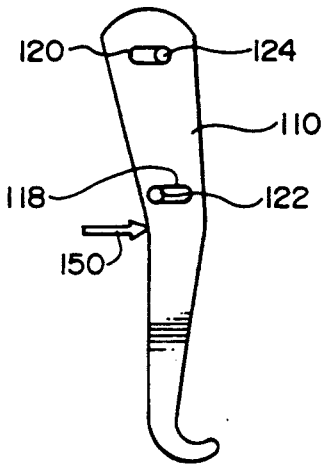
FIGS. 5–10 are phantom right side elevation views of a trigger of the present invention in various stages of action superimposed on simple force diagrams of the mechanics involved.

FIG. 5 shows the trigger 110 at rest, with the actuator force 150 from actuator 112 urging the trigger 110. As was also shown in FIG. 2, the first pivot peg 122 is at the rear edge of first slot 118 and the second pivot peg 124 is at the front edge of second slot 120.

Figure 6:
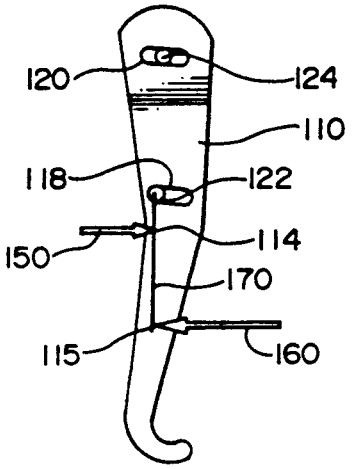

FIG. 6 shows the trigger 110 having rotated around first pivot peg 122 with the second pivot peg 124 in the middle of second slot 120. At this point, the actuator 112 is urging the air valve away from the valve seat, as described in connection with prior art spray gun 10 of FIG. 1. The operator force 160 is applied to trigger 110 by an operator's fingers over a relatively broad grasping region, but operator force 160 can be considered mathematically to be applied at a single operator location 115 located roughly at the center of the grasping region. Hence, trigger 110 forms a second-class lever 170, that is, a lever 170 in which the moving force (operator force 160) and the resisting force (actuator force 150) are on the same side of the fulcrum (pivot peg 122). The mechanical advantage gained by this lever 170 is represented by the formula:

$$\text{Mechanical Advantage} = \frac{\text{Operator Distance}}{\text{Resisting Distance}}$$

where Operator Distance is the distance from operator location 115 to the first pivot peg 122 and the Resisting Distance is the distance from actuator interface location 114 to the first pivot peg 122. In a preferred embodiment, the Operator Distance is approximately 2½ inches, the Resisting Distance is approximately ½ inches, and the mechanical advantage is approximately 5:1.

Figure 7:
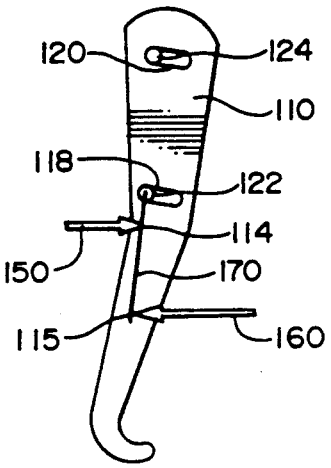
Figure 8:
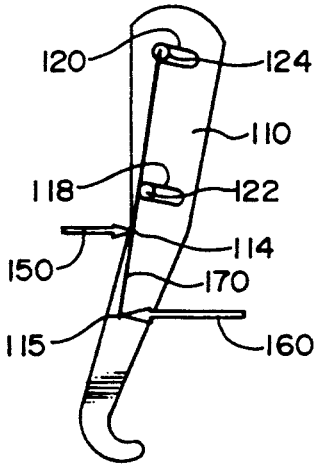

FIG. 7 shows the second pivot peg 124 at the rear edge of second slot 120. At this time, the pivot point or fulcrum of the simple lever 170 changes from the first pivot peg 122 to the second pivot peg 124, as shown in FIG. 8. Also by this time, the air valve will be opened and the pressure on both sides of the valve will be substantially equalized. Thus, it will no longer be necessary or desirable to use the large mechanical advantage present when the trigger 110 pivots about the first pivot peg 122. In fact, a smaller mechanical advantage means that the air valve moves a greater distance with an identical movement of the trigger 110, thus the trigger 110 is capable of positioning of the gun valves through a broader range of positions. This results in greater control or "sensitivity" to operator modulation of the air and paint valves in the second range of operation.

Figure 9:
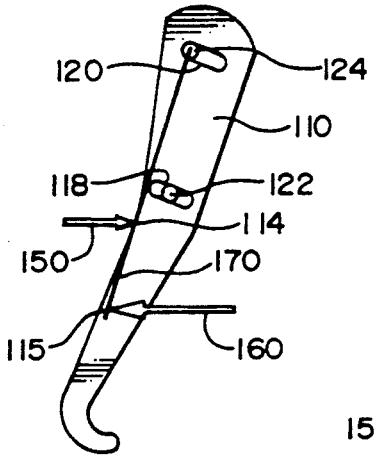

FIG. 9 shows the trigger 110 pivoting about second pivot peg 124 with the first pivot peg 122 approximately centered in the first slot 118. The simple lever 170 formed by the trigger 110 in this position runs from the second pivot peg 124 to operator location 115. In a preferred embodiment, the Operator Distance is approximately 3⅓ inches and the Resisting Distance is approximately 1⅓ inches, resulting in a mechanical advantage of approximately 2.5:1.

Figure 10:
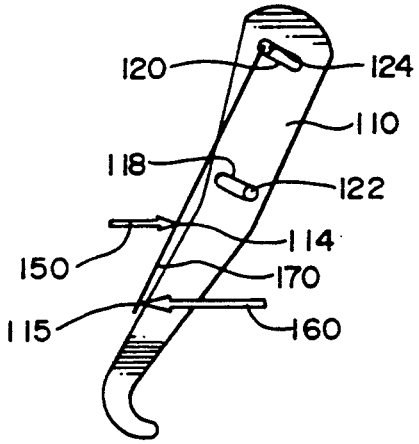

FIG. 10 shows the first pivot peg 122 at the front edge of first slot 118. This fully actuated position is the furthest that the trigger 110 can be pulled by an operator.

Thus, the present invention is capable of providing a significant mechanical advantage when a valve must be opened against a pressurized fluid, while also reducing the mechanical advantage and increasing control of fluid flow when the pressure on both sides of the valve have substantially equalized.

The invention is not to be taken as limited to all of the details thereof as modifications and variations thereof may be made without departing from the spirit or scope of the invention. For instance, while the embodiment described was in connection with a pressurized air paint spray gun, it would be obvious to one skilled in the art to use the invention on airless paint spray guns or on other spray guns having similar triggering requirements. In addition, the present invention would be functional even if the first slot 118 and the second slot 120 were replaced by a single, large aperture with the first pivot peg 122 projecting through a lower portion of the aperture and the second pivot peg 124 projecting through the upper portion of the aperture. Finally, one skilled in the art would see that it is within the practice of this invention to create a double-pivot trigger by placing pivot pegs 122, 124 on the trigger 110 and slots 118, 120 in the gun 100.

I claim:

1. A trigger assembly for opening an air valve and a paint valve in a spray gun, the trigger assembly comprising:

a) a trigger having
   i) an elongated body extending from a first end to a second end,
   ii) a first aperture in the elongated body, and
   iii) a second aperture intermediate the first aperture and the first end of the elongated body;

b) a first pivot peg mounted on the spray gun and projecting into the first aperture such that the first aperture slides past the first pivot peg;

c) a second pivot peg mounted on the spray gun and projecting into the second aperture such that the second aperture slides past the second pivot peg; and d) an actuating means for actuating the air valve and paint valve, the actuating means being in operational contact with the trigger intermediate the first aperture and the second end of the elongated body, such that when the trigger is pulled and rotated about the first pivot peg, the actuating means opens the air valve, and when the trigger is further pulled and rotated about the second pivot peg, the actuating means opens the paint valve.

2. The trigger assembly of claim 1, further comprising e) an urging means for urging the trigger toward a rest position, the urging means located intermediate the first aperture and the second end of the trigger.

3. The trigger assembly of claim 2 wherein the urging means comprises a spring urging the actuator means against the trigger.

4. The trigger assembly of claim 1, wherein the actuator means is a stiff rod.

5. The trigger assembly of claim 1, wherein the trigger has a grasping region centered approximately 2 and ½ inches from the first aperture and approximately 3 and ½ inches from the second aperture.

6. The trigger assembly of claim 5, wherein the actuator means abuts the trigger approximately ½ inch from the first aperture.

7. A paint spray gun comprising:

a) a gun body having a handle and an air passageway for allowing pressurized air to pass therethrough;

b) an air valve situated inside the air passageway of the gun body for controlling the flow of pressurized air through the fluid air passageway, the valve opening when moved against the flow of pressurized air through the gun;

c) a paint valve for allowing paint to enter the flow of pressurized air;

d) an actuating means for actuating the air valve and the paint valve through physical movement, such that when the actuating means is moved from a rest position, the air valve opens, and as the actuating means is further moved from the rest position, the paint valve then opens;

e) a trigger pivotably attached to the gun and located adjacent to the actuator means such that when the trigger is pulled toward the handle, the actuator means is moved from the rest position and the air valve is moved against the flow of pressurized air, the trigger having:
   i) an elongated body extending from a first end to a second end,
   ii) a first aperture in the elongated body, and
   iii) a second aperture intermediate the first aperture and the first end of the elongated body;

f) a first pivot peg mounted on the gun body and projecting into the first aperture of the trigger such that the trigger pivots about the first pivot peg during a first range of motion during which the air valve is opened by the actuator means, and such that there is a relative sliding motion between the first pivot peg and the first aperture during a second range of motion during which the position of the paint valve is controlled by the actuator means;

g) a second pivot peg mounted on the gun body and projecting into the second aperture of the trigger such that there is a relative sliding motion between the second pivot peg and the second aperture during the first range of motion and that the trigger pivots about the second pivot peg during the second range of motion.

8. The paint spray gun of claim 7, further comprising:

h) urging means for urging the trigger away from the handle of the gun body, the urging means being located intermediate the first aperture and the second end of the trigger.

9. The paint spray gun of claim 8 wherein the urging means comprises a spring urging the actuator means against the trigger away from the handle.

10. A method of controlling an air valve and a paint valve in a spray gun, the spray gun having a gun body and a trigger with a first end and a second end, the air valve opening when moved against air pressure and being attached to an actuator which is moved by pulling the trigger near the second end of the trigger, and the paint valve also being attached to the actuator and opening after the actuator opens the air valve, the method comprising the steps of:

a) pivoting the trigger about a first pivot point while moving the first end of the trigger transversely with respect to a second pivot point such that the actuator opens the air valve;

b) abutting a portion of the trigger against the second pivot point after the valve is opened and fluid pressure is substantially equal on both sides of the valve;

c) pivoting the trigger about the second pivot point while moving the trigger transversely with respect to the first pivoting point such that the actuator moves the paint valve into a fully open position.

11. The method of claim 10, further comprising the step of:

d) urging the actuator against the trigger so as to cause the air valve to close and the trigger to return to a rest position when the trigger is released.

12. The method of claim 10, wherein step a) further comprises:

i) opening the air valve against the air pressure; and ii) substantially equalizing the air pressure on both sides of the air valve.

13. The method of claim 10, wherein step b) further comprises:

abutting a pivot peg attached to the spray gun body against an interior edge of an aperture in the trigger.

14. The method of claim 10, wherein step b) further comprises:

abutting a pivot peg attached to the trigger against an interior edge of an aperture in the spray gun body.

15. The method of claim 10, wherein step c) further comprises:

moving a needle end of the actuator so as to open the paint valve.

16. A method of controlling an air valve and a paint valve in a paint spray gun via a pivoting trigger, the method comprising the steps of:

a) pivoting the trigger about a first position on the trigger having a high mechanical advantage when moving the air valve from a closed to a slightly open condition; and b) pivoting the trigger about a second position on the trigger having a low mechanical advantage for moving the position of the paint valve to a fully open condition.

17. A method of controlling the spraying of a paint spray gun through a double-pivot trigger connected to an air valve and a paint valve, the method comprising:

a) pivoting the trigger about a first pivot point in a first range of motion;

b) causing the trigger to open the air valve during the first range of motion of the trigger;

c) pivoting the trigger about a second pivot point in a second range of motion, wherein the trigger has a lower mechanical advantage when pivoting about the second pivot point than when pivoting about the first pivot point;

d) causing the trigger to open the paint valve after the air valve is opened to allow paint to be pulled from the gun by the pressurized air; and e) controlling the position of the paint valve by pivoting the trigger in the second range of motion.

18. The method of claim 17, further comprising the step of:

f) switching the trigger from pivoting about the first pivot point to pivoting the trigger about the second pivot point by abutting the trigger against the second pivot point after the trigger has moved through the first range of motion.

* * * * *